US009120539B1

(12) United States Patent
Binder

(10) Patent No.: US 9,120,539 B1
(45) Date of Patent: Sep. 1, 2015

(54) BOAT COVER SUPPORT

(71) Applicant: Kurwin J. Binder, Pembroke, MA (US)

(72) Inventor: Kurwin J. Binder, Pembroke, MA (US)

( * ) Notice: Subject to any disclaimer, the term of this patent is extended or adjusted under 35 U.S.C. 154(b) by 0 days.

(21) Appl. No.: 14/081,599

(22) Filed: Nov. 15, 2013

(51) Int. Cl.
*B63B 17/00* (2006.01)
*B63B 17/02* (2006.01)

(52) U.S. Cl.
CPC ..... *B63B 17/02* (2013.01)

(58) Field of Classification Search
CPC ..... B63B 17/00; B63B 17/02
USPC ..... 114/343, 361, 364
See application file for complete search history.

(56) References Cited

U.S. PATENT DOCUMENTS

| | | | | |
|---|---|---|---|---|
| 3,106,931 | A | 10/1963 | Cooper | |
| 3,424,178 | A | 1/1969 | Yazaki | |
| 3,855,643 | A | 12/1974 | Sanfrod et al. | |
| RE30,044 | E | 7/1979 | Huddle | |
| 4,347,690 | A | 9/1982 | Wallace, Jr. | |
| 5,419,273 | A | 5/1995 | Cutler | |
| 5,452,678 | A | 9/1995 | Simpkins | |
| 5,730,281 | A | 3/1998 | Powell et al. | |
| 5,944,039 | A | 8/1999 | Bergeron | |
| 6,158,377 | A * | 12/2000 | Szukhent, Jr. | 114/361 |
| 6,260,505 | B1 | 7/2001 | Polidan | |
| 6,289,909 | B1 | 9/2001 | Wood | |
| 6,672,241 | B2 * | 1/2004 | Warfel et al. | 114/361 |
| 6,983,716 | B1 * | 1/2006 | Ankney et al. | 114/361 |
| 7,270,075 | B1 * | 9/2007 | Jones | 114/361 |
| 7,275,555 | B2 | 10/2007 | Powell et al. | |
| 7,296,584 | B2 | 11/2007 | Goldwitz | |
| 7,472,666 | B1 | 1/2009 | Richard et al. | |
| 7,484,472 | B1 * | 2/2009 | Highfield | 114/361 |
| 7,520,240 | B2 * | 4/2009 | Tufte | 114/361 |
| D603,059 | S | 10/2009 | VanElverdinghe | |
| 7,770,591 | B2 | 8/2010 | Tseng | |
| D624,199 | S | 9/2010 | VanElverdinghe | |
| 7,814,723 | B2 | 10/2010 | VanElverdinghe | |
| 8,011,986 | B1 | 9/2011 | Curtsinger | |
| 8,359,994 | B1 * | 1/2013 | Highfield | 114/361 |

* cited by examiner

*Primary Examiner* — Daniel V Venne
(74) *Attorney, Agent, or Firm* — John P. McGonagle

(57) ABSTRACT

A pontoon boat cover support assembly is provided. Aluminum, cylindrical brackets having a vertical orientation, are fastened to the outer perimeter of the pontoon boat deck. A rib assembly, each with a central, top, four-way fitting, having a bottom inserted into a pair of cylindrical brackets on opposite sides of the deck. A number of rib assemblies are fastened to each other with ridge poles sections interconnected to the a four-way fittings on each pair of ribs. A central, adjustable pole extends downwardly from a rib brace, positioned below each four-way fitting, to the deck or other surface.

7 Claims, 6 Drawing Sheets

BOAT COVER SUPPORT

CROSS-REFERENCE TO RELATED APPLICATIONS

Applicant claims the priority benefits of U.S. provisional Patent Application No. 61/727,018, filed Nov. 15, 2012.

BACKGROUND OF THE INVENTION

This invention relates to boat covers, and in particular, to a support apparatus for a boat cover.

Protection of boats against weather elements during off-season storage has had problems associated with it. Indoor storage within a shed or hanger is preferable, but is very expensive. Outdoor storage requires a cover for the boat to prevent snow, ice, and water from damaging the boat during storage. Tarpaulins have not been wholly successful due to unsupported sections of the tarpaulin accumulating ice, water and debris.

It has become common to replace tarpaulins with shrink wrapping plastic about the top side of the boat. A heat-shrinkable plastic film is draped over the boat deck and heat from a blow dryer is then applied to the plastic to shrink it tight about a line below the deck and over the deck. The shrunk plastic prevents any sunken portions forming in the plastic and thereby prevents water pooling to form. However, the plastic film has inherent weaknesses against storms or severe wind, which may tear the plastic film itself. The film is also subject to punctures from any pointed object such as found in debris, e.g., broken branches, stones, glass pieces, and the like.

Tarpaulins provide rugged and reusable protection as boat covers. Pole structures have been devised to support the tarpaulin along the center line of the boat. While these pole structures are suitable for small boats with relatively small beams, tarpaulins installed over larger beamed boats with only a center support still sag to form low points for collection of water. The tarpaulins or shrink wrap plastic installed on larger boats are commonly supported by haphazard home-made structures made from pieces of lumber secured together to form a frame above the deck onto which the tarpaulin or shrink wrap plastic is placed.

Compounding the above boat cover issues, are that few available cover systems are available for pontoon boats. A pontoon boat includes, generally, two or more pontoons that support a boat deck that, in turn, accommodates passengers. Most of the available cover systems are configured for installation on a typical, non-pontoon boat. Typical prior art cover and frame systems are not designed for use on a pontoon boat having a large flat surface area or on a pontoon boat having a railing system or sidewalls. The pontoon boat may also have a low deck rail along another portion of the pontoon boat. Prior art cover systems generally require extensive clamping mechanisms to secure the cover system to the boat. The lightweight railing system of the pontoon boat may not support the bracket and screw clamping means of the prior art.

It is desirable to have a frame for providing support for a pontoon boat cover, which is reusable, easy to assemble and provides center line and lateral support for a tarpaulin or shrink wrap plastic sheet without the need for extensive bracket and clamping means. Furthermore, the support should provide support for the cover to extend over any pontoon boat railing system or sidewalls, as well as any outboard motor portions.

SUMMARY OF THE INVENTION

The present invention addresses this need by providing a pontoon boat cover support assembly. A plurality of open, aluminum, cylindrical brackets having a vertical orientation, are fastened to the outer perimeter of the pontoon boat deck. A plurality of ribs, each with a central, top, four-way fitting, are provided, the bottom of each rib adapted for insertion into a pair of cylindrical brackets on opposite sides of the deck. The ribs are fastened to each other with ridge poles sections interconnected to the a four-way fittings on each pair of ribs. A central, adjustable pole extends downwardly from a rib brace, positioned below each four-way fitting, to the deck or other surface.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be made to the accompanying drawings and descriptive matter in which there is illustrated a preferred embodiment of the invention.

DETAILED DESCRIPTION OF THE INVENTION

Figure 1:
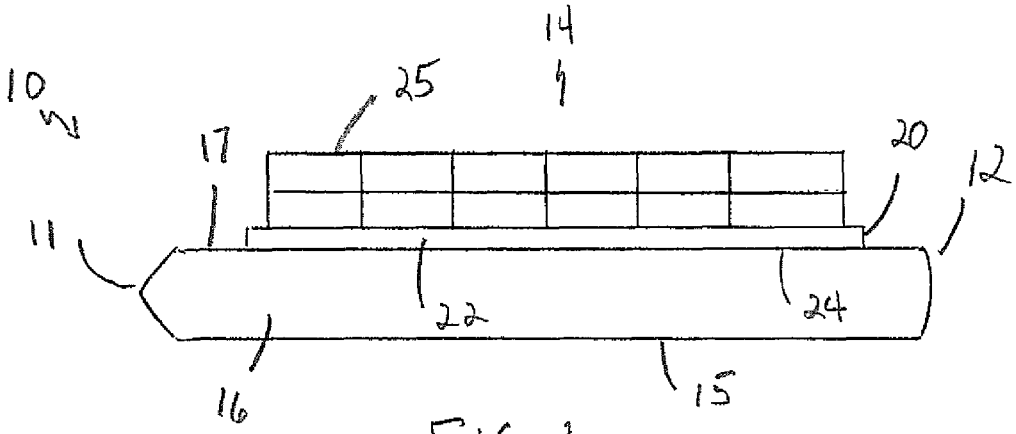
FIG. 1 is a side view of a pontoon boat
Figure 2:
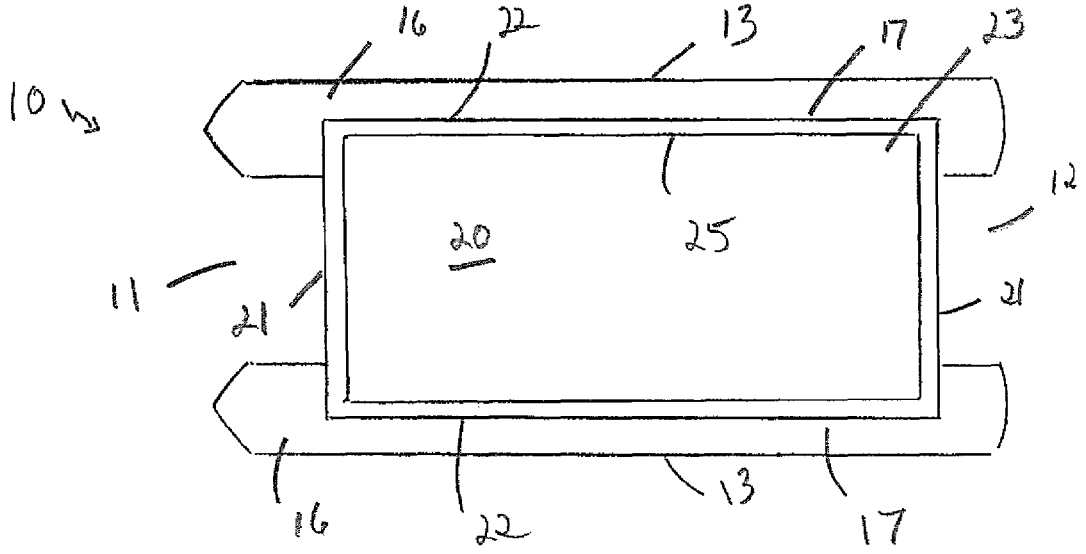
FIG. 2 is a top view of a pontoon boat.
Figure 3:
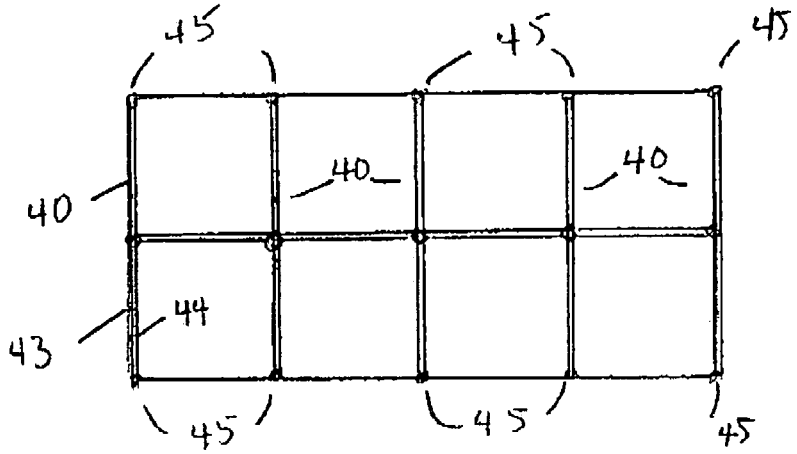
FIG. 3 is a top view of the pontoon deck with boat cover support.
Figure 4:
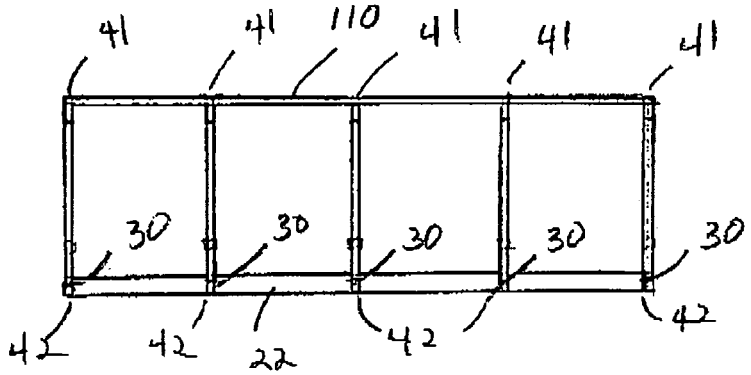
FIG. 4 is a side view of the pontoon deck with boat cover support.
Figure 6:
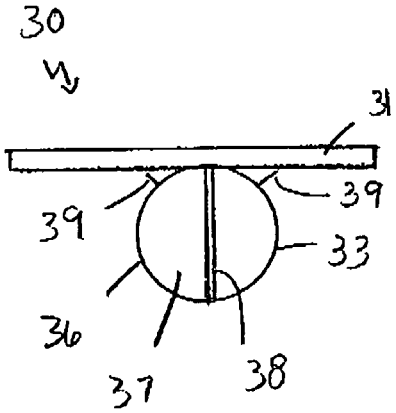
FIG. 6 is a top view of the cylindrical bracket.
Figure 5:
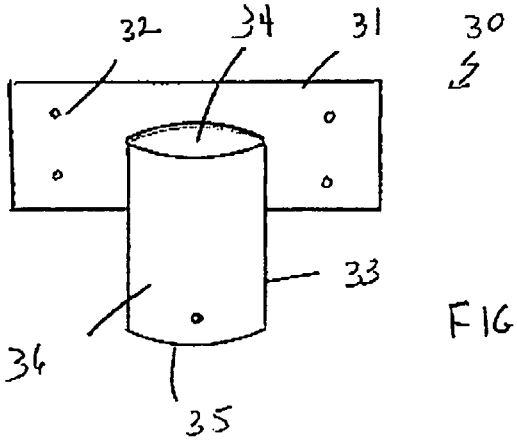
FIG. 5 is a front view of a cylindrical bracket.
Figure 7:
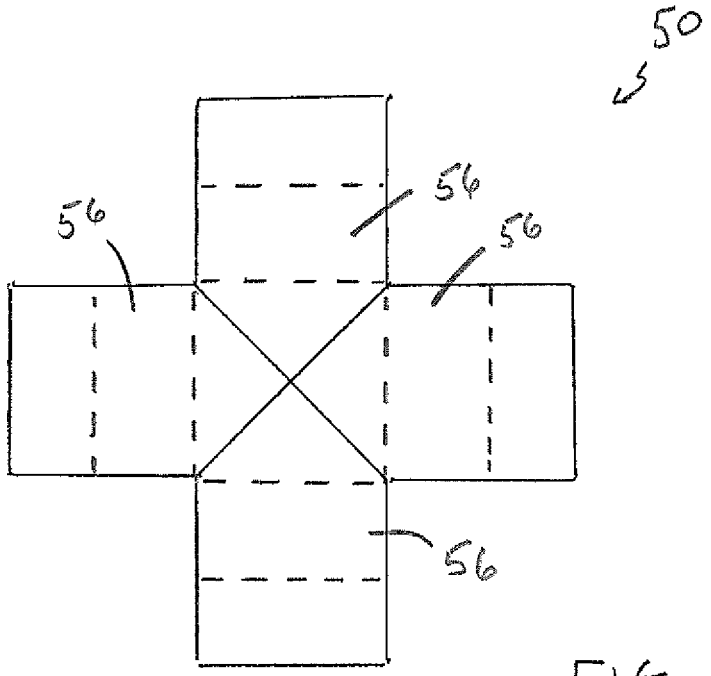
FIG. 7 is a bottom view of a four-way fitting.
Figure 8:
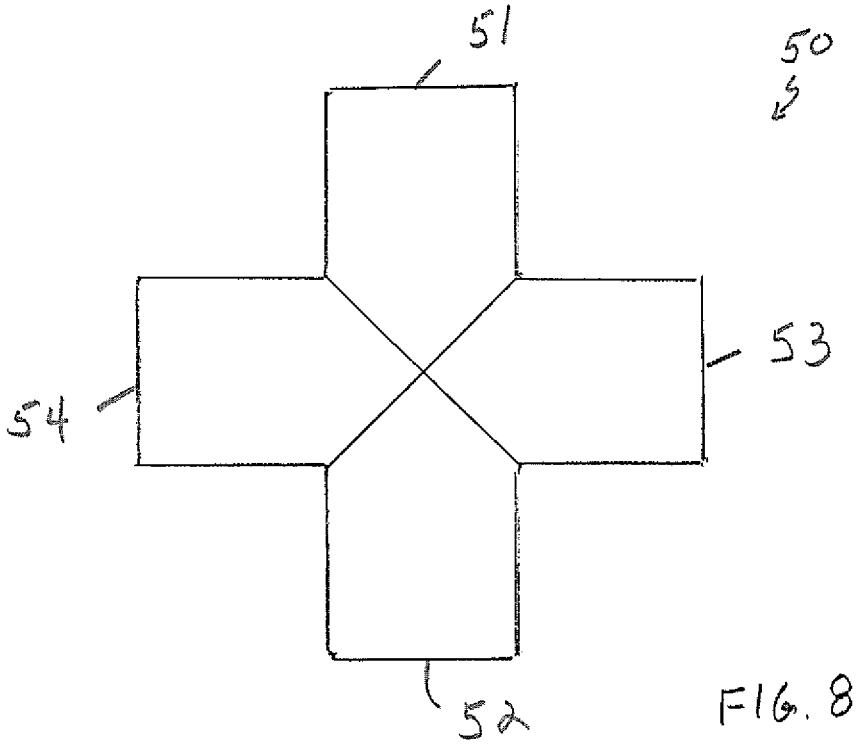
FIG. 8 is a top view of a four-way fitting.
Figure 9:
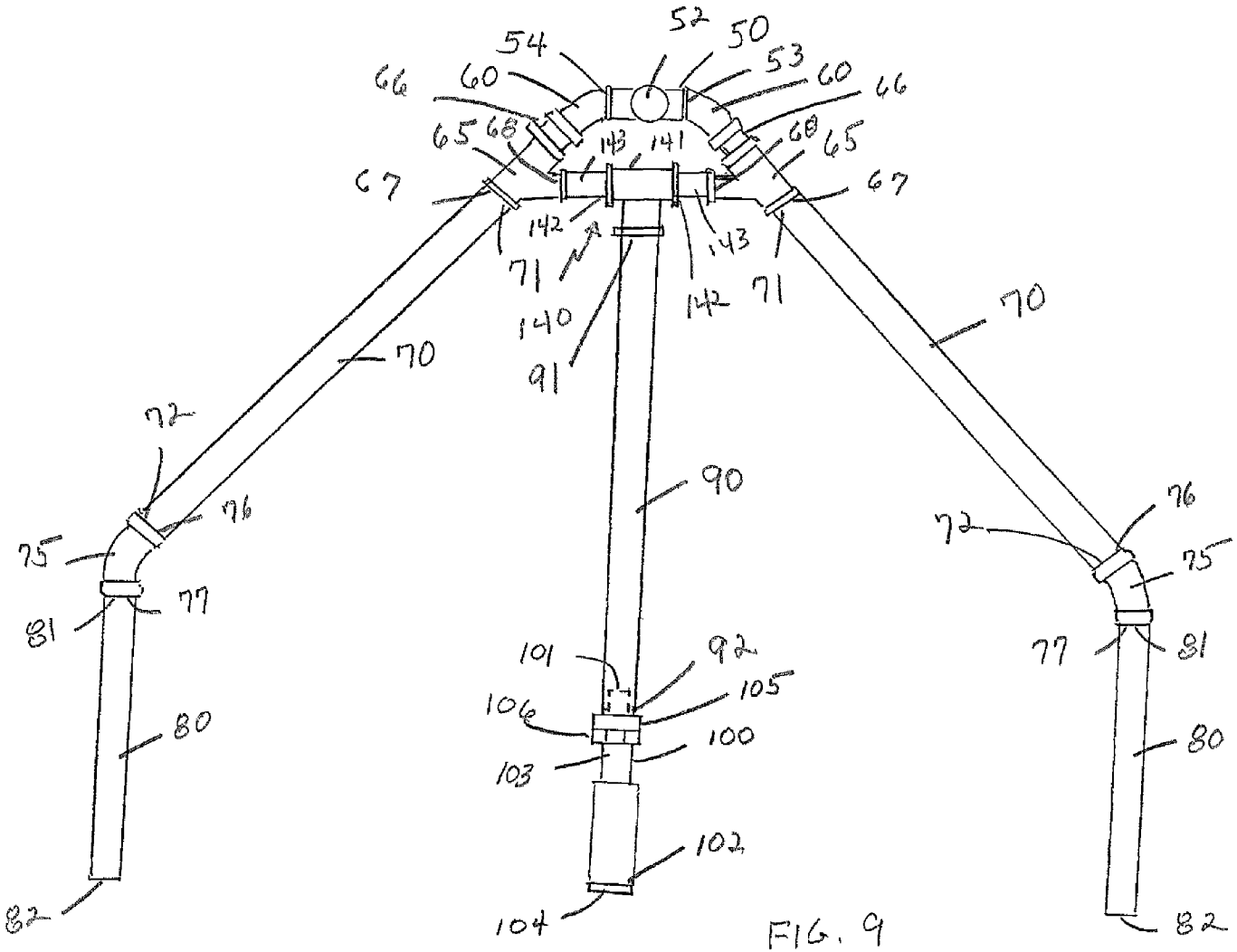
FIG. 9 is a front view of a rib assembly.
Figure 10:
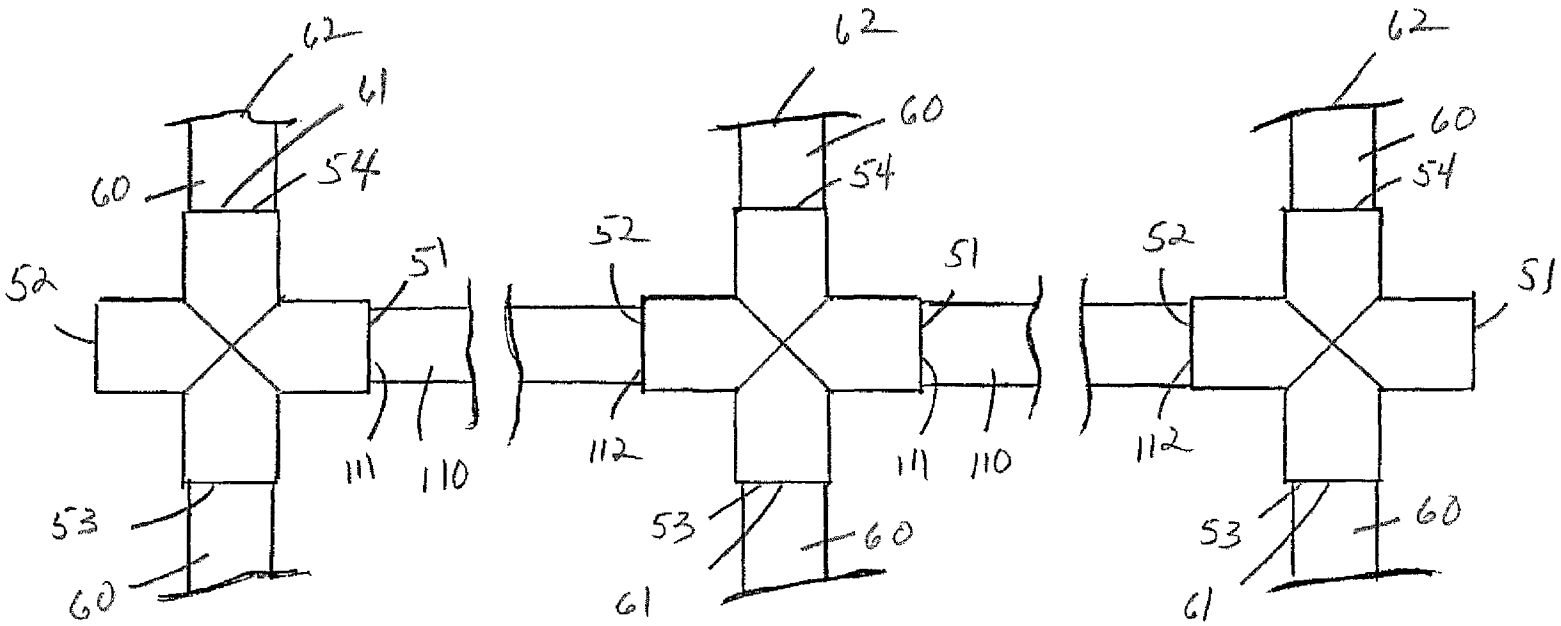
FIG. 10 is a partial top view of three rib assemblies with interconnected four-way fittings.
Figure 11:
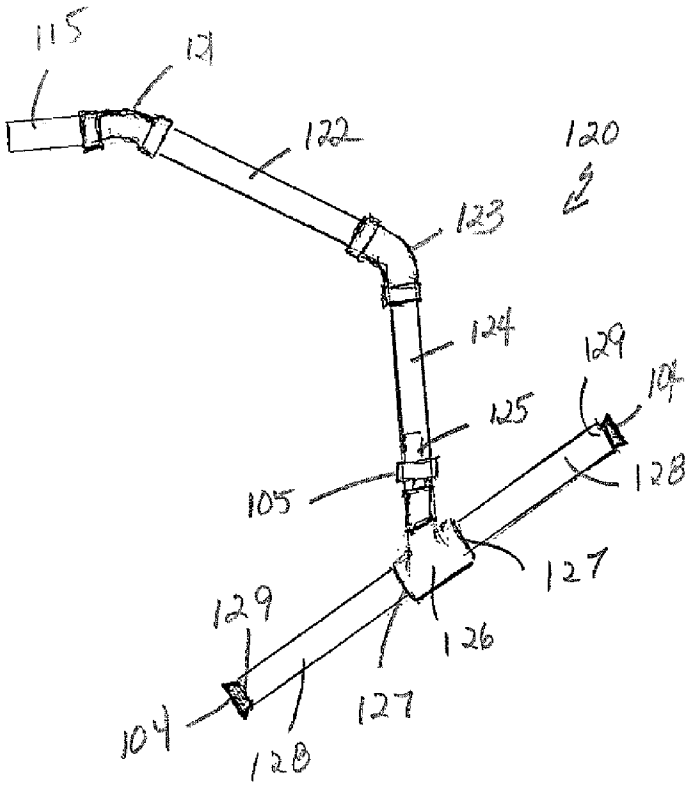
FIG. 11 is a side view of a rear leg assembly.
Figure 12:
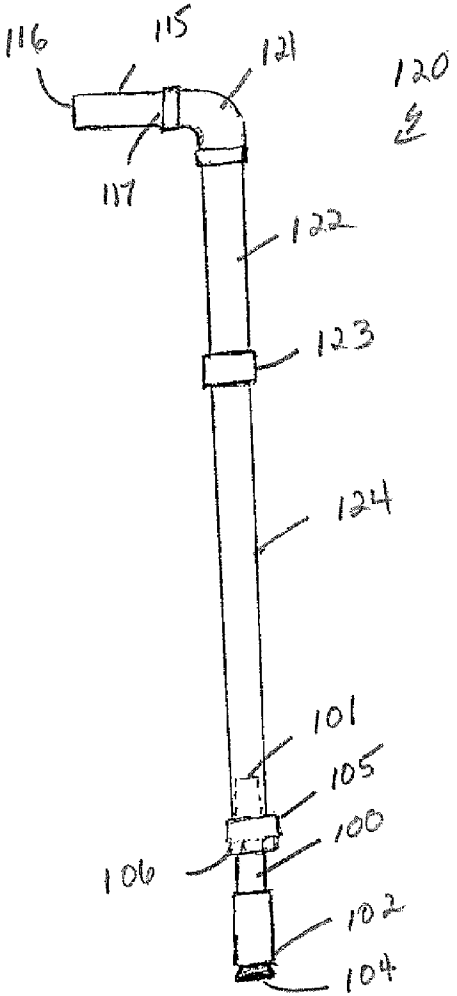
FIG. 12 is a side view of an alternate rear leg assembly.

Referring to the drawings in detail wherein like elements are indicated by like numerals, there is shown a typical pontoon boat 10 having a forward portion 11, aft portion 12, two, opposite lateral sides 13, a top portion 14 and a bottom portion 15, said forward and aft portions defining a longitudinal axis of the boat. The boat 10 has two, elongated pontoons 16, each having a longitudinal axis parallel to the longitudinal axis of the boat, said pontoons each being positioned adjacent a lateral boat side 13. A generally rectangular deck 20 having a top surface 23 and bottom surface 24 is provided, said deck bottom surface 24 attached to the tops 17 of the pontoons 16. The deck short sides 21 are oriented toward the boat forward and aft portions 11, 12 and have a deck short side longitudinal axis perpendicular to the boat longitudinal axis. The deck long sides 22 are oriented toward the boat lateral sides 13, each deck long side having a deck long side longitudinal axis parallel to the boat longitudinal axis. The deck top surface 23 has a railing system 25 extending about at least a portion of the perimeter of the deck. Various pontoon boats have railing systems 25 that may entirely or partially traverse the deck top surface 23.

The present invention provides a plurality of cylindrical brackets 30 attached to the deck long sides 22. Each bracket 30 is comprised of a generally rectangular fastening plate 31 attached to the deck long sides 22 by means of conventional marine fasteners 32. A hollow, vertical cylinder 33 having an open top 34, open bottom 35 and cylindrical side wall 36, extending from bottom 35 to top 34, is attached to each fastening plate 31 by means of a weld 39 between a portion of the side wall 36, adjacent to the cylinder top 34, and the fastening plate 31. The cylinder top, bottom and side wall define a cylinder interior 37. A pin 38 is inserted into the cylinder interior extending diametrically from a portion of the side wall to an opposite portion of the side wall, adjacent the cylinder bottom 35. The cylinders 33 are positioned along each deck long side 22 parallel to the cylinders on the opposite long side, nominally forty-two inches apart.

The present invention further includes a plurality of rib assemblies 40, each rib assembly 40 positioned in a vertical plane perpendicular to the longitudinal axis of the boat. Each rib assembly 40 has a top 41, a bottom 42, front 43, rear 44, and two lateral sides 43. The rib assembly top 41 is comprised of a four-way hollow fitting 50. The four-way fitting 50 has a rear horizontal cylindrical opening 51, an opposite front horizontal cylindrical opening 52, and two opposite lateral horizontal cylindrical openings 53, 54. Each four-way opening 51-54, has an optional annular insert 56 contained therein, said inserts standardizing the insert depth of attachment pipes.

Two short hollow connector pipes 60, each having a first end 61 and a second end 62, have their first ends 61 inserted into each four-way fitting lateral opening 53, 54. A forty-five degree hollow shoulder elbow connector 65, having a first opening 66 and a second opening 67, has its first opening 66 attached to each short connector pipe second end 62. Two straight, elongated hollow shoulder pipes 70, each having a first end 71 and a second end 72, has their first ends 71 inserted into a shoulder elbow connector second opening 67. A forty-five degree hollow lateral elbow connector 75, having a first opening 76 and a second opening 77, has its first opening 76 receiving a shoulder pipe second end 72. A hollow lateral vertical pipe 80, having a first end 81 and a second end 82, has its first end 81 inserted into each lateral elbow second opening 77. The lateral vertical pipe second end 82 is adapted to fit into the cylindrical bracket cylinder 33 via the cylinder open top 34 into the cylinder interior 37 to rest on the cylinder pin 38.

Each rib assembly 40 has a rib brace 140 comprised of a hollow T-connector 141 interconnected to each of the forty-five degree hollow shoulder elbow connector third openings 68. The T-connector 141 has two lateral openings 142 with short interconnecting pipes 143 interconnecting each T-connector lateral opening 142 with an adjacent forty-five degree hollow shoulder elbow connector third opening 68.

Each rib assembly 40 includes a hollow vertical center leg 90, having a first end 91 and a second end 92. The vertical center leg first end 91 is inserted into a vertically downwardly facing T-connector third opening 144. A hollow section of foot pipe 100 is telescopically positioned within the vertical center leg second end 92. The foot pipe has a first end 101 and a second end 102, said foot pipe first end 101 fully inserted into the vertical center leg second end 92. The foot pipe surface 103 may be scored with ridges. A trap adapter 105 is provided to hold the foot pipe 100 a desired telescopic length from the center leg. The trap adapter 105 is a compression type fitting that uses a tapered washer 106 to seal. The more the washer 106 is tightened, the tighter the seal. The scored foot pipe surface 103 enhances the gripping power of the trap adapter 105. The foot pipe second end 102 has a rubber plug 104 inserted therein. The vertical center leg overall length as determined by the center leg 90 and foot pipe 100 is consequently adjustable to accommodate any changes in deck top surface 23 or items attached to the deck surface. The rubber plug 104 acts as a resilient footing preventing unsightly marring of the deck surface.

The number of rib assemblies 40 used is a function of the boat length, with each rib assembly being nominally forty-two inches apart. Four rib assemblies are used for boat lengths of fourteen to sixteen feet in length. Five rib assemblies are used for boat lengths of seventeen to twenty feet in length. Six rib assemblies are used for boat lengths of twenty-one to twenty-four feet in length. Seven rib assemblies are used for boat lengths of twenty-five to twenty-eight feet in length. Eight rib assemblies are used for boat lengths of twenty-nine to thirty-two feet in length.

The rib assemblies 40 are interconnected by means of hollow ridge pole section pipes 110 having a first end 111 and a second end 112. Each ridge pole first end 111 is inserted into a four-way fitting rear horizontal cylindrical opening 51, seated to the insert 56. The ridge pole second end 112 is inserted into a four-way fitting front horizontal opening 52 in an adjacent rib assembly 40, seated to the insert 56.

Where it is desirable to provide boat cover support rearward of the rib assemblies, a rear leg assembly 120 is provided. The rear leg assembly 120 includes a shortened ridge pole 115 having a first end 116 and a second end 117, said shortened ridge pole first end 116 being inserted into the last rib assembly four-way fitting rear horizontal cylindrical opening 51. The shortened ridge pole second end 117 terminates in a first rear elbow 121. The first rear elbow may be a 90° or 45° depending upon the coverage desired. The first rear elbow 121 has a first rear pipe section 122 extending therefrom. The first rear pipe section terminates in a coupling 123 which may be a 180° connector or 45° elbow. A vertical rear pipe 124 is connected to said coupling 123 and extends vertically downward. A hollow section of rear foot pipe 125 is telescopically positioned within the vertical rear pipe. A trap adapter 105 is provided to hold the rear foot pipe 125 a desired telescopic length from the vertical rear pipe 124. As stated above, the trap adapter 105 is a compression type fitting that uses a tapered washer 106 to seal. The more the washer 106 is tightened, the tighter the seal. The rear foot pipe may terminate in a rubber footing 104 or in a hollow T-connector 126 with two, opposite lateral openings 127. Each lateral opening 127 may have a rear lateral pipe 128 protruding laterally therefrom. Each rear lateral pipe may have a rubber footing 104 inserted into its distal end 129.

The pipes and coupling elements are preferably made from polyvinyl chloride, i.e., PVC. The PVC is lightweight but strong. The PVC is also impervious to weather elements and will not corrode or rot. The shoulder pipes 70 may have different lengths to accommodate different boat beams as well as railings 25. The lateral vertical pipes 80 may also have different lengths to accommodate railings 25 and other height requirements. It may be desirable to tie the front rib assembly to the rear rib assembly to prevent the ridge poles 110 from coming loose from the four-way fittings 50.

It is understood that the above-described embodiment is merely illustrative of the application. Other embodiments may be readily devised by those skilled in the art, which will embody the principles of the invention and fall within the spirit and scope thereof. The invention may be claimed as a kit or as a fully assembled pontoon boat cover support assembly.

I claim:

1. A pontoon boat cover support, comprising:

a plurality of open, aluminum, cylindrical brackets having a vertical orientation fastened to an outer perimeter of a pontoon boat deck;

a plurality of rib assemblies, each rib assembly positioned in a vertical plane perpendicular to a longitudinal axis of the pontoon boat, each said rib assembly having a top, a bottom, front, rear, and two lateral sides, said rib assembly top comprised of a four-way hollow fitting, said four-way hollow fitting having a rear horizontal cylindrical opening, an opposite front horizontal cylindrical opening, and two opposite lateral horizontal cylindrical openings, wherein each said rib assembly bottom is adapted for insertion into a pair of said cylindrical brackets on opposite sides of said outer perimeter of the pontoon boat deck;

wherein said plurality of rib assemblies are fastened to each other with ridge pole sections interconnected to the four-way fittings on each rib assembly;

wherein each rib assembly has a rib brace with a central, adjustable pole extending downwardly to the pontoon boat deck.

2. A pontoon boat cover support as recited in claim 1, wherein each cylindrical bracket is comprised of:

a generally rectangular fastening plate attached to the pontoon boat deck outer perimeter;

a hollow, vertical cylinder attached to said fastening plate, each said hollow vertical cylinder having an open top, open bottom and cylindrical side wall extending from cylinder bottom to cylinder top, said cylinder top, bottom and side wall defining a cylinder interior;

a pin inserted into the cylinder interior and extending diametrically from a portion of the cylindrical side wall to an opposite portion of the cylindrical side wall, adjacent the cylinder bottom.

3. A pontoon boat cover support as recited in claim 2, wherein each rib assembly is further comprised of:

two short hollow connector pipes, each said short hollow connector pine having a first end and a second end, each said short hollow connector pipe having said first end inserted into a four-way fitting lateral opening;

two upper forty-five degree hollow shoulder elbow connectors, each having a first opening, a second opening and a third opening, each said upper forty-five degree hollow shoulder elbow connector having said first opening attached to a short connector pipe second end;

two straight, elongated hollow shoulder pipes, each said straight, elongated hollow shoulder pipe having a first end and a second end, each shoulder pipe first end inserted into an upper forty-five degree hollow shoulder elbow connector second opening;

two lower forty-five degree hollow lateral elbow connectors, each lower forty-five degree hollow lateral elbow connectors having a first opening and a second opening, each said lower forty-five degree hollow lateral elbow connector first opening receiving a straight, elongated hollow shoulder pipe second end;

two hollow lateral vertical pipes, each hollow lateral vertical pipe having a first end and a second end, said hollow lateral vertical pipe first end inserted into each said lower forty-five degree hollow lateral elbow second opening;

wherein said lateral vertical pipe second end is adapted to fit into the cylindrical bracket through the cylindrical bracket hollow vertical cylinder open top into the cylindrical bracket cylinder interior to rest on the cylindrical bracket pin.

4. A pontoon boat cover support as recited in claim 3, wherein said rib brace is further comprised of:

a hollow T-connector interconnecting each rib assembly upper forty-five degree hollow shoulder elbow connector third opening, said T-connector having two lateral openings with short interconnecting pipes interconnecting each T-connector lateral opening with an adjacent upper forty-five degree hollow shoulder elbow connector third opening;

wherein said central, adjustable pole is comprised of a hollow vertical center leg having a first end and a second end, said hollow vertical center leg first end inserted into a vertically downwardly facing rib brace hollow T-connector third opening;

a hollow section foot pipe telescopically positioned within the said hollow vertical center leg second end, said hollow section foot pipe having a first end and a second end, said hollow section foot pipe first end inserted into the hollow vertical center leg second end;

a trap adapter about said hollow vertical center leg and said hollow section foot pipe to hold the hollow section foot pipe a desired telescopic length from the hollow vertical center leg; and a rubber plug inserted into said hollow section foot pipe second end.

5. A pontoon boat cover support as recited in claim 4, further comprising:

a plurality of hollow ridge pole section pipes interconnecting said rib assemblies, each hollow ridge pole section pipe having a first end and a second end, each ridge pole section pipe first end inserted into the four-way hollow fitting rear horizontal cylindrical opening, each hollow ridge pole second end inserted into the four-way hollow fitting opposite front horizontal cylindrical opening in an adjacent rib assembly.

6. A pontoon boat cover support as recited in claim 5, further comprising a rear leg assembly, comprising:

a shortened ridge pole having a first end and a second end, said shortened ridge pole first end inserted into a last rib assembly four-way fitting rear horizontal cylindrical opening, said shortened ridge pole second end terminating in a first rear elbow, said first rear elbow having a first rear pipe section extending there from, said first rear pipe section terminating in a coupling;

a vertical rear pipe connected to said coupling and extending vertically downward;

a hollow section of rear foot pipe telescopically positioned within the vertical rear pipe;

a trap adapter about said vertical rear pipe and hollow section of rear foot pipe to hold said hollow section of rear foot pipe a desired telescopic length from the vertical rear pipe.

7. A pontoon boat cover support as recited in claim 6, further comprising:

an annular insert within each four-way hollow fitting horizontal cylindrical opening.

* * * * *